United States Patent [19]

Senzaki et al.

[11] 4,338,141

[45] Jul. 6, 1982

[54] FORMATION OF ZINC PHOSPHATE COATING ON METALLIC SURFACE

[76] Inventors: Takashi Senzaki; Ryoichi Murakami, both c/o Nippon Paint K.K., 19-17 Ikeda Nakamachi, Neyagawa-shi, Osaka; Kiyotada Yasuhara; Masashi Takahashi, both c/o Nippon Paint K.K., 1-15 Minami Shinagawa 4-chome, Shinagawa-ku, Tokyo, all of Japan

[21] Appl. No.: 145,587

[22] Filed: May 1, 1980

[30] Foreign Application Priority Data

May 2, 1979 [JP] Japan ..... 54-54399

[51] Int. Cl.[3] ..... C23F 7/08

[52] U.S. Cl. ..... 148/6.15 Z

[58] Field of Search ..... 148/6.15 Z

[56] References Cited

U.S. PATENT DOCUMENTS 3,333,988 8/1967 Douty et al. ..... 148/6.15 Z 3,676,224 7/1972 Snee ..... 148/6.14 Z 3,850,700 11/1974 Heller ..... 148/6.15 Z

FOREIGN PATENT DOCUMENTS 110060 2/1974 German Democratic Rep. ..... 148/6.15 Z

*Primary Examiner*—Ralph S. Kendall

*Attorney, Agent, or Firm*—Alexis Barron

[57] ABSTRACT

An acidic aqueous zinc-containing coating solution containing about 0.4 to about 1 g/l of zinc, about 5 to about 40 g/l of phosphate, about 2 to about 5 g/l of chlorate, and about 0.01 to about 0.2 g/l of nitrite, and useful for forming on metal surfaces zinc phosphate coatings that exhibit excellent adhesion to a paint film and excellent corrosion resistance after painting when used as an undercoat for the cationic electrodeposition of a paint film, and a process for applying coating composition, including continuous spray or intermittent spray.

37 Claims, 16 Drawing Figures

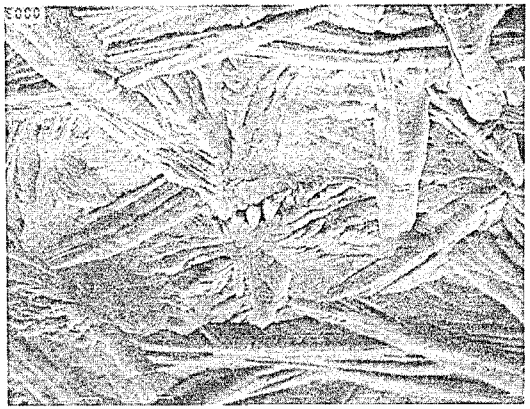
1
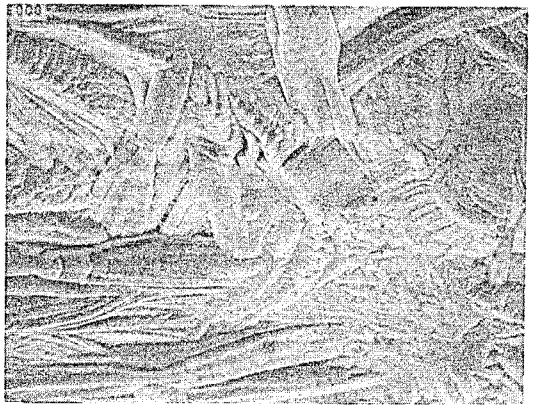
2
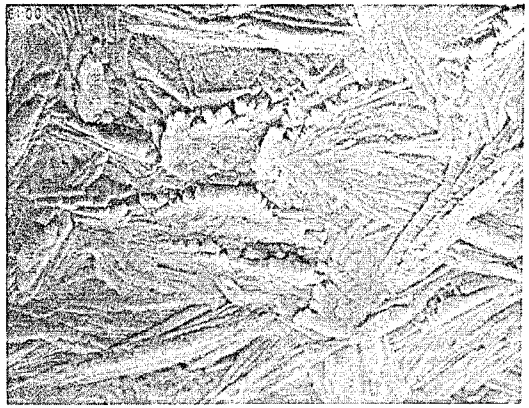
3
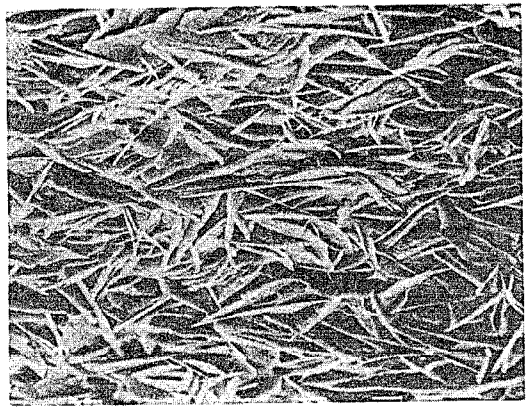
4

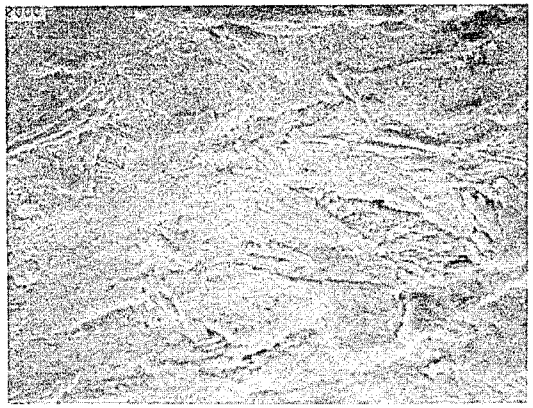
5
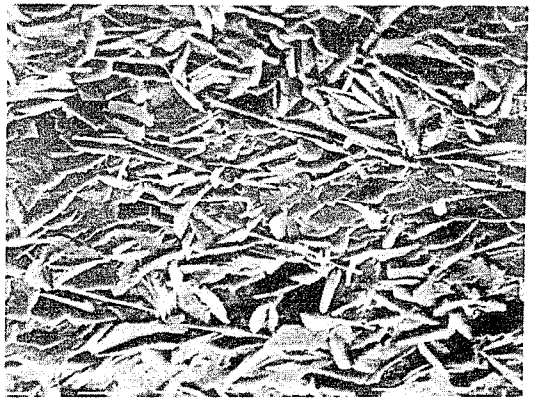
6
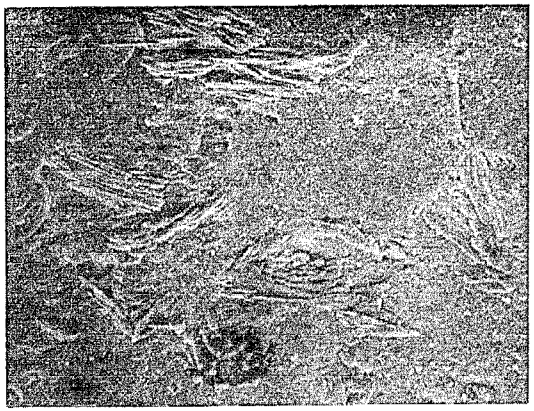
7
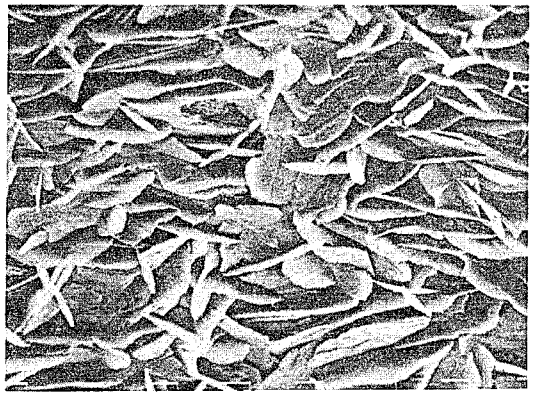
8

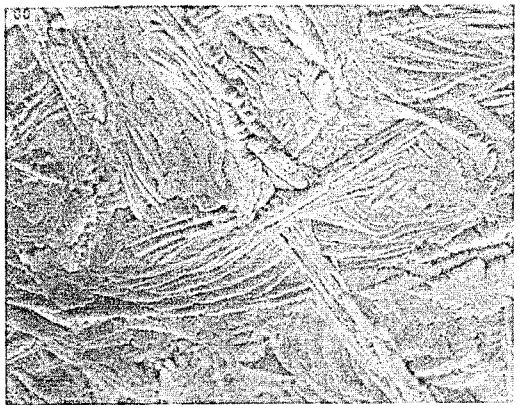
9
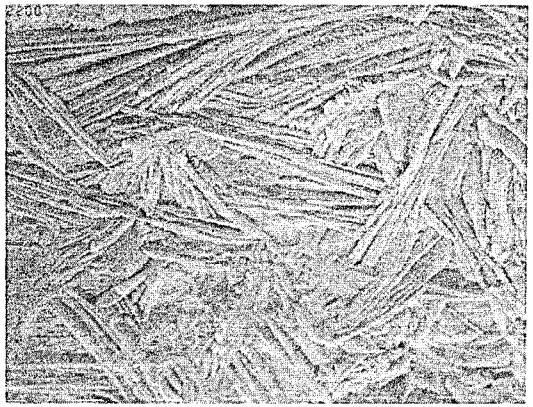
10
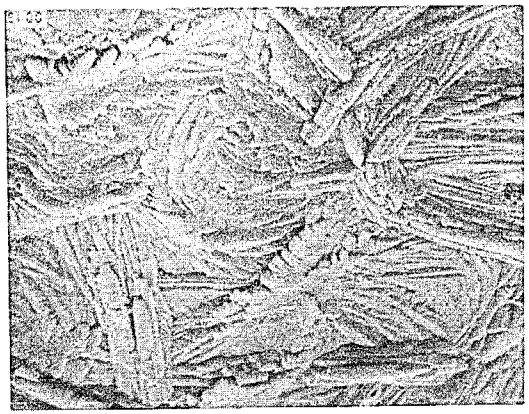
11
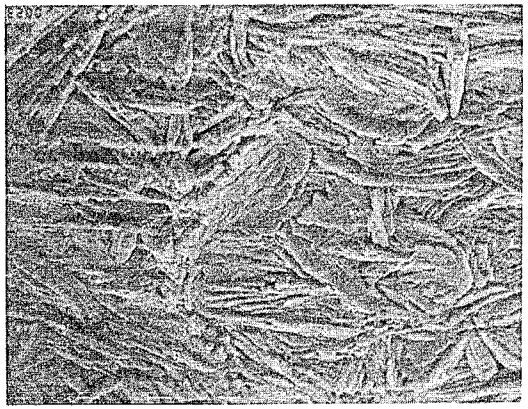
12

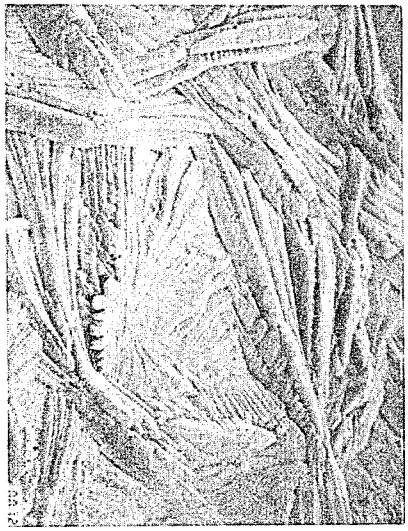
13
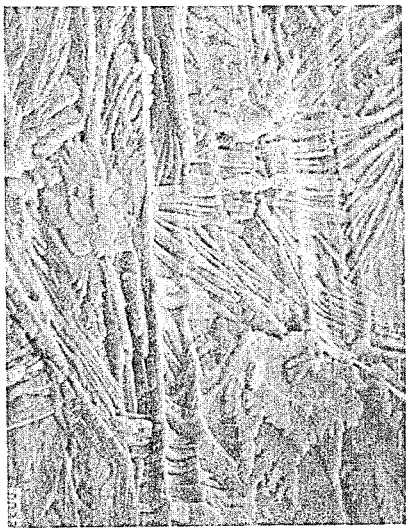
14
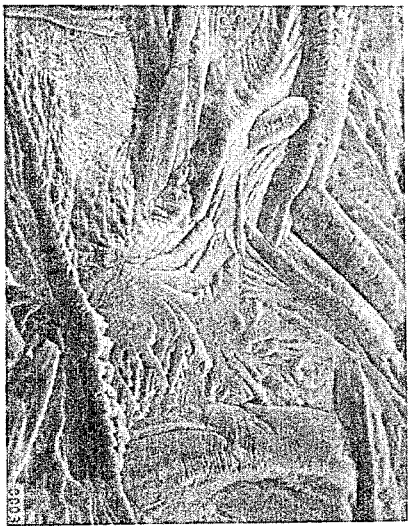
15
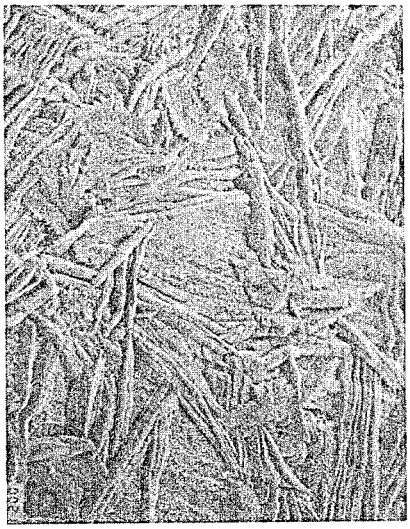
16

FORMATION OF ZINC PHOSPHATE COATING ON METALLIC SURFACE

BACKGROUND OF THE INVENTION

The present invention relates to a process for forming a zinc phosphate coating on a metal surface and to a zinc phosphate coating composition. More specifically, it relates to a process, and composition useful therein, for forming on a metal surface a zinc phosphate coating that comprises an undercoat for the cationic electrodeposition of a paint film. The coating exhibits good corrosion resistance and adheres well to the paint film.

Generally, zinc phosphate coatings have been applied as an undercoat or primer for paint films applied by anionic electrodeposition so as to give better adhesion and corrosion resistance. The most common method of application is by spraying due to the cost of facilities and the efficiency of production.

Zinc phosphate coatings applied by spraying and suitable as an undercoat for anionic electrodeposition, as well as specific coating compositions for use therewith, are disclosed in many papers and patents. For example, Japanese Patent Publication No. 5086/1973 has proposed to add 0.5 to 8.0 mg/l of a copper ion to the usual zinc phosphate coating composition to reduce the rate of elution of the zinc phosphate coating during electrodeposition.

Japanese Patent Publication No. 34655/1973 has proposed to add to the known zinc phosphate coating composition 0.02 to 0.1g/l of an aluminum ion, 0.04 to 0.4 g/l of an arsenic ion and 0.02 to 2.0 g/l of a fluoride ion, together with 0.01 to 0.13 g/l of a nitrite ion as an oxidizer. According to the disclosure, the amount of the converted or formed coating dissolved during electrodeposition is reduced; the electrical conductivity is good; the appearance and rust resistance of the paint film are superior to those of the prior art; and contamination of the paint used in continuous application is remarkably reduced.

Japanese Patent Publication No. 6418/1975 has proposed to control the weight ratio of zinc to phosphoric radicals within the range of from 1:12 to 1:110, preferably from 1:20 to 1:100. This lower ratio of zinc to phosphoric radical provides thin, dense and even zinc phosphate coatings that contain a large proportion of iron resulting in a higher acid resistance. As a result, when the pH at the boundaries of the object being coated shifts to the acid side of the pH range during electrodeposition, the amount of elution of the undercoat decreases, thereby reducing the amount of the undercoat mixed into the paint film and the amount of reaction between them. This is said to remarkably reduce deterioration in the paint film.

Thus, with regard to undercoats for anionic electrodeposition, various improvements, including the addition of metal ions to the coating composition and control of the ratio of zinc to phosphoric acid in the coating liquid, have been proposed to provide coatings having excellent acid resistance and electrical conductivity.

In recent years, steel materials of which only one side is galvanized or alloyed with zinc have been used to enhance corrosion resistance after painting. The other side of such one-side galvanized steel, to which a trace of plating zinc adheres, requires buffing before use. Paints themselves are shifting from the anion type to the cation type. In particular, such a shift is being prompted in the automobile industry by a desire to minimize openings or holes in the underbody and rust on the body panels.

Various problems that can be encountered in the use of prior art zinc phosphate coating compositions in cationic electrodeposition applications are: the cationic electrodeposited films do not possess their normal properties, with the result that corrosion resistance is not much better than when iron phosphate coatings are used; adhesion is much worse than when iron phosphate coatings are used; and, in the "Checkerboard Test" after immersion in hot water, the entire film can come off. A good result is obtained only when the undercoat is treated with a chromic acid.

Our studies of differences between anionic and cationic electrodeposition and undercoats suitable for cationic electrodeposition have revealed the following:

First, as disclosed in Japanese Patent Disclosure No. 77144/1977, cationic electrodeposition paints, unlike anionic electrodeposition paints, are cured or hardened when the alcohol blocking the bridging agent (i.e. isocyanate) evaporates during baking. Thus, a large degree of contraction of the paint film occurs during baking, thereby exerting a considerable force on the undercoat. For this reason, it is necessary that the zinc phosphate undercoat for cationic electrodeposition, unlike that for anionic electrodeposition, possess sufficient strength to withstand contraction of the paint film.

Second, in cationic electrodeposition, the vicinity of the object being treated becomes alkaline so that it is necessary for the undercoat to have excellent alkali resistance. This is in contrast to anionic electrodeposition in which the vicinity of the object becomes considerably acidic.

Our studies of zinc phosphate coatings, compositions which form such coatings, and methods of applying such compositions have revealed that there is a strong correlation between achieving the aforementioned properties of strength and alkali resistance and the crystal structure of the resultant zinc phosphate coating. It has been observed that coatings formed from prior coating compositions have a leaf-like crystal structure (see Photograph 4), very poor adhesion to cationic electrodeposition paints, and very poor corrosion resistance. In contrast, the coatings formed according to the present invention have a substantially plate-like crystal structure (see Photograph 1) that does not grow in the vertical direction to the substrate, and this plate-like crystal structure exhibits both sufficient adhesion to the paint film and sufficient corrosion resistance after painting to serve as an undercoat for cationic electrodeposition paints. The coatings of the present invention, without treatment with chromic acid, have exhibited better adhesion and corrosion resistance than those prior zinc phosphate coatings treated with chromic acid.

OBJECTS OF THE INVENTION

It is an object of the invention to provide an acidic aqueous composition for forming over a metal surface a zinc phosphate coating as an undercoat for cationic electrodeposition of a paint film, which coating exhibits excellent paint adhesion and corrosion resistance after painting.

It is a further object of the invention to provide a coating having the aforementioned properties without treatment with chromic acid.

It is yet another object of the invention to provide a method of applying such coatings to a metal surface in a manner which consistently produces coatings having the aforementioned properties, the formation of which is not dependent on the use of any specific metal surface.

SUMMARY OF THE INVENTION

The present invention includes the provision of an acidic aqueous zinc phosphate coating composition containing about 0.4 to about 1 g/l of dissolved zinc, about 5 to about 40 g/l of dissolved phosphate and about 0.01 to about 0.2 g/l of dissolved nitrite. Such a composition can be applied to a metal surface by spraying to form thereon a zinc phosphate coating having adhesion and corrosion-resistant properties which make it particularly suitable as an undercoat for cationic electrodeposition. The composition is capable of being used to form zinc phosphate coatings which are uniform in nature, relatively dense and relatively low in amount (about 1 to about 1.8 g/m$^2$).

In applying the composition, it is preferred to maintain its temperature within a range of from about 40° to about 70° C., and to apply it at a spraying pressure of about 0.5 to about 2 kg/cm$^2$ and a spraying time of greater than about 40 seconds, most preferably from about 1 to about 3 minutes.

As discussed in detail below, there are applications where advantages can be realized by applying the composition utilizing intermittent spraying, and for these applications, the composition includes also about 2 to about 5 g/l of chlorate. Intermittent spraying of the composition comprises the following sequential steps:

(a) spraying the metallic surface for about 10 to about 30 seconds;

(b) suspending the spraying for about 5 to about 30 seconds; and (c) spraying the surface again for a time such that the total time of spraying of the surface is greater than about 40 seconds, preferably from about 1 to about 3 minutes.

The aqueous coating solution may contain, in addition to the aforementioned essential ingredients, one or more of: nickel, cobalt, calcium and manganese ions, and one or more of nitrate,chloride/ and complex fluoride ions.

BRIEF DESCRIPTION OF THE DRAWING

The drawing shows crystal structure of Examples and Comparative Examples.

DETAILED DESCRIPTION OF THE INVENTION

As to the concentration of the zinc ion, one of the essential ingredients of the zinc phosphate coating composition of the present invention, if a sufficient amount of zinc is not present in the composition, there tends to be formed coatings which are not uniform in that they consist partially of blue iron phosphate coatings. The presence of an excess amount of zinc ion in the composition tends to produce a uniform zinc phosphate coating, but one that tends to possess a leaf-like crystal structure that is considered not as suitable an undercoat for cationic electrodeposition in that adhesive and corrosion-resistant properties are not as good as desired. In forming coatings having the desired properties, the zinc ion may be present at a concentration within the range of about 0.4 to about 1 g/l, preferably from about 0.5 to about 0.9 g/l.

As regards the phosphate ion concentration, if this constituent is not present in a sufficient amount, there tends to be produced coatings which are not uniform and the coating composition tends to be unbalanced. The preferred amount of dissolved phosphate is about 10 to about 20 g/l, although there can be used compositions which contain about 5 to about 40 g/l of the phosphate. With a phosphate concentration above about 40 g/l, little or no improvements are realized over those achieved by the use of lower amounts, and excess chemical is wasted.

In connection with the nitrite ion concentration, if it is not sufficient, there tends to be produced undesirable coatings with yellow rust, whereas excess amounts of nitrite tend to produce non-uniform zinc phosphate coatings which tend to include blue iron phosphate coatings. In forming coatings having desired properties, the nitrite concentration may range from about 0.01 to about 0.2 g/l, preferably from about 0.04 to about 0.15 g/l.

With respect to those applications in which chlorate is used, if a sufficient amount of chlorate is not used, the coatings formed tend to possess a leaf-like crystal structure, and as mentioned above, this type of strucure is associated generally with coatings which have less than desirable adhesive and corrosion-resistant properties, when such coatings serve as an undercoat for cationic electrodeposition. Excess amounts of chlorate in the composition tend to lead to the formation of non-uniform zinc phosphate coatings which include blue iron phosphate coatings. Such non-uniform coatings generally exhibit good adhesive properties, but poor corrosion-resistant properties. In forming coatings having desired properties, the chlorate concentration is in excess of the amount required to oxidize ferrous iron which is produced by the coating reaction. In this regard, the chlorate concentration may range from about 2 to about 5 g/l, preferably from about 2.5 to about 4 g/l.

The source of zinc ion can be a soluble zinc-containing compound, for example, zinc oxide, zinc carbonate and zinc nitrate. The source of phosphate can be a soluble compound which is a source of this anion, for example, phosphoric acid, sodium phosphate and other alkali metal phosphates, zinc phosphate and nickel phosphate. The source of nitrite can be a soluble compound which is a source of this anion, for example, sodium nitrite and other alkali metal nitrites, and ammonium nitrite. The source of chlorate can be a soluble chlorate-containing compound which is a source of this anion, for example, chloric acid, sodium chlorate and other alkali metal chlorates and ammonium chlorate.

The temperature of the coating composition may range from about 40° to about 70° C., and preferably from about 50° to about 60° C. At temperatures below about 40° C., coatings can be formed, but the formation of coatings is relatively slow so that it takes a long time to form good coatings. At temperatures above about 70° C., the coat-formation accelerator (i.e. nitrite ion) tends to decompose and this can lead to precipitation in the coating composition, making the coating composition unbalanced. This can lead to the formation of poor coatings.

Preferably, the coating composition is applied at a spraying pressure of from about 0.5 to about 2 kg/cm$^2$.

The time of application of the coating composition may be longer than about 40 seconds, preferably from about 1 to about 3 minutes, and more preferably from about 1.5 to about 2.5 minutes. If shorter times are employed, coating formation may not be complete, particularly in those portions of the object being coated where direct spraying is difficult, and poor coatings (e.g. ones with yellow rust or iron phosphate coatings) are formed there. If longer times are employed, the result is not much better than that obtained using the times stated above, and larger application facilities are required.

As mentioned above, there are applications in which advantages can be realized by applying the coating composition by intermittent spray rather than continuous spray. For example, exemplary of applications where undue etching is encountered are applications in which easily etched steel is being coated, for example, substrates including a welded iron portion that has been buffed, or steel having one side galvanized that has been buffed, if in applying the coating composition by continuous spray, the composition tends only to etch the substrate, or non-uniform coatings, blue-iron phosphate coatings, or yellow rust coatings tend to be formed. Then, intermittent spray can be used to form the desired coatings.

Intermittent spraying includes spraying the substrate for about 10 to about 30 seconds, then suspending spraying for about 5 to about 30 seconds, and then utilizing a second spraying, with the total spraying time being longer than about 40 seconds, preferably from about 1 to about 3 minutes. When the spraying is suspended for a period of from about 5 to about 30 seconds after about 10 to about 30 seconds of the first spraying, it appears that etching of the substrate is suppressed enough so that a crystalline nucleus for a dense and even zinc phosphate coating is formed. Then, the second spraying, it appears, permits this crystalline nucleus to grow in the form of crystals having the desired plate-like crystal structure of the present invention.

The time of such first spraying may range from about 10 to about 30 seconds, preferably from about 15 to about 25 seconds. With times less than about 10 seconds, it appears that the steel substrate is not etched sufficiently, with the result that the crystal nucleus for an even zinc phosphate coating tends not to be formed. Then, it further appears that, no matter how long the substrate is sprayed after the suspension, a blue-iron phosphate coating tends to be formed. With times longer than about 30 seconds, it appears that the crystal nucleus tends to grow too much to produce the crystal structure of the present invention.

The time of suspension may range from about 5 to about 30 seconds, preferably from about 10 to about 20 seconds. With times shorter than about 5 seconds, formation of a nucleus for an even and fine zinc phosphate coating tends not to be completed, and this can lead to a poor result. With times longer than about 30 seconds, although a nucleus for an even coat grows, the portions of the substrate surrounding the nucleus tend to form an iron phosphate coat in the acidic atmosphere. This can lead to the formation of an uneven and poor coating. Two or three cycles of spraying, each cycle consisting of a first spraying, then a suspension of spraying, and then a second spraying may be employed, preferably with the total time of spraying being longer than about 1 minute.

With the aforementioned treating method, consistent results can be achieved even though a variety of surface conditions exist on the object being coated, and there are provided coatings having sufficient paint adhesion and corrosion resistance after painting to serve as an undercoat for the cationic electrodeposition of a paint film. To carry out the intermittent spray method on a commercial scale, in accordance with the speed of the conveyor, those spray nozzles in the spray machine that the object being coated would pass during the period of suspension of spraying can be removed.

It is preferred that the zinc phosphate coating composition contain, in addition to the zinc, phosphate, nitrite and chlorate ions mentioned above, one or more of nickel, cobalt, calcium and manganese which can aid in forming even and dense zinc phosphate coatings over buffed portions of iron or steel plates or galvanized steel plates. The concentration of one or a combination of these non-essential ions may be at least about 0.2 g/l, preferably from about 0.2 to about 2 g/l. With a concentration below about 0.2 g/l, little or no better result is achieved than without the ion. With a concentration above about 2 g/l, the result is little better than that obtained with concentrations within the aforementioned range, which is disadvantageous from the economical point of view.

Suitable metal-containing compounds which are soluble in the coating composition can be used as the source of the aforementioned dissolved metals. Examples of the source of nickel ion are nickel carbonate, nickel nitrate, nickel chloride and nickel phosphate. Examples of the source of cobalt ion are cobalt carbonate, cobalt nitrate, cobalt chloride, and cobalt phosphate. Examples of the source of calcium ion are calcium carbonate, calcium nitrate, calcium chloride, and calcium phosphate. Examples of the source of manganese ion are manganese carbonate, manganese nitrate, manganese chloride and manganese phosphate.

Furthermore, about 0 to about 15 g/l of nitrate, about 0 to about 5 g/l of a chloride ion and about 0 to about 4 g/l of a complex fluoride ion may be added to the coating composition. These ions are considered to be non-essential components of the coating composition of the present invention.

The surface of the metal to be coated according to the invention may be iron, zinc, aluminum or their alloys, particularly iron in many cases. In order to simultaneously coat a number of metal objects whose surface conditions are different from each other, it is preferred to employ the aforementioned intermittent spray method.

The prior art zinc phosphate coating compositions do not provide an undercoat having sufficient adhesion and corrosion resistance, as measured by salt-water spray resistance and point-rust resistance, to serve as a suitable undercoat for cationic electrodeposition. The cationic electrodeposited paint films on such undercoats exhibit poor adhesion and corrosion resistance. In contrast, the zinc phosphate coating compositions of the present invention provide an undercoat for cationic electrodeposition paint films that exhibits remarkably improved paint adhesion and corrosion resistance after painting.

One embodiment of the invention will be described below. The object to be treated was sprayed with an alkaline grease removing agent (e.g., "RIDOLINE 75N-4" of NIPPON PAINT) at a temperature from 55° to 60° C. for 2 minutes to remove the grease. After being washed with city water, it was then sprayed with an acidic zinc phosphate coating composition consisting mainly of 0.4 to 1 g/l of zinc ion, more than 0.2 g/l of nickel ion, 5 to 40 g/l of phosphate ion, 2 to 5 g/l of chlorate ion and 0.01 to 0.2 g/l of nitrite ion at a temperature from 40° to 70° C. and a spraying pressure of from 0.5 to 2 kg/cm$^2$ for a period of from 1 to 3 minutes, and then washed with city water and deionized water. The following examples are illustrative, but non-limiting embodiments of the present invention. Comparative examples are also provided.

EXAMPLES 1 through 3

Three sets of test plates of commercially available cold rolled steel (70×150×0.8 mm) were sprayed with an alkaline grease removing agent (2% by weight of "RIDOLINE 75N-4" of NIPPON PAINT) at 60° C. for 2 minutes to remove the grease. After being washed with city water, the sets were continuously sprayed as set out in Table 1 for a period of from 1 to 3 minutes, one set being coated as defined in Example 1 of Table 1, another set as defined in Example 2 of Table 1, and the last set as defined in Example 3 of Table 1. Then, each set was washed with city water and deionized water, and dried.

TABLE 1

| | EXAMPLE 1 | EXAMPLE 2 | EXAMPLE 3 |
|---|---|---|---|
| Aqueous Coating Composition (g/l) | | | |
| Zn ion | 0.60 | 0.51 | 0.92 |
| $PO_4$ ion | 14.3 | 15.2 | 13.8 |
| $ClO_3$ ion | 3.0 | 2.6 | 3.9 |
| $NO_2$ ion | 0.08 | 0.10 | 0.06 |
| Ni ion | 0.53 | — | 1.33 |
| Ca ion | — | — | 0.50 |
| Cl ion | — | 1.0 | 1.8 |
| $NO_3$ ion | 4.2 | — | 7.9 |
| Conditions of Treatment | | | |
| Total acidity | 15.7 | 16.1 | 15.0 |
| Free acidity | 0.6 | 0.5 | 0.7 |
| Toner value | 2.0 | 2.4 | 1.5 |
| Treating temperature (°C.) | 50 | 50 | 50 |
| Treating time (minutes) | 2 | 2 | 2 |
| Spraying pressure (kg/cm$^2$) | 0.8 | 0.8 | 0.8 |

The test plates thus coated with the aforementioned zinc phosphate coating compositions were examined for the amount of coating, the crystal structure, and the appearance of the coatings. The results are summarized in Table 2. Photographs showing the crystal structures of the coatings were taken with a scanning electromicroscope (JSM-T20 of NIPPON ELECTRONICS) at an angle of 45° and a magnification of 1500 times.

The test plates having a zinc phosphate coating were then painted with a cationic electrodeposition paint ("POWER TOP U-30 BLACK" of NIPPON PAINT) at a thickness of 20 microns (at a voltage of 250 volts for an on-time of 3 minutes) and baked at 180° C. for 30 minutes. Some of the electrodeposited test plates were subjected to the 5%-salt-water spraying test (JIS-Z-2371) for 1000 hours. The results are shown in Table 2.

Other electrodeposited test plates were painted with an intermediate paint. ("ORGA TO 778 GRAY" of NIPPON PAINT) at a thickness of 30 microns, and then with a finishing paint ("ORGA TO 226 MARGUERITE WHITE" of NIPPON PAINT) at a thickness of 40 microns, thus giving 3-coat, 3-baked painted plates.

After immersion in deionized water at 50° C. for 10 days, some of the three-coat, painted plates were cut with a sharp cutter in a grid pattern consisting of 100 squares of 2×2 mm. Then, an adhesive tape was applied to the cut surface and peeled off to measure the adhesion by counting the number of squares still adhering to the plate (the "Checkerboard Test").

The remaining three-coat, painted plates were placed at an angle of 15° to a horizontal surface, and a 140-mm long arrow, weighing 1.00 g, and having a conical head with a vertical angle of 90°, and made of alloyed tool steel (the quality being JIS-G-4404 and the hardness being above Hv 700), was permitted to fall vertically onto the surface of the plate from a height of 150 cm to produce 25 flaws on the painted surface. Then, these painted plates were subjected to 4 cycles of a corrosion test (hereinafter referred to as the "point rust test"), each cycle consisting of the 5%-salt-water spraying test (JIS-Z-2371 for 24 hours); wet test (at 40° C. at a relative humidity of 85% for 120 hours); and then allowed to stand in a room for 24 hours. Then, thread rusts and the average maximum diameter of blisters on the paint surfaces were examined. The results are summarized in Table 2.

COMPARATIVE EXAMPLES 1 through 5

Five sets of the same type of test plates as in EXAMPLES 1-3 were employed. Each set was sprayed with a zinc phosphate coating composition as defined in Table 3. In COMPARATIVE EXAMPLE 5, after application of the zinc phosphate coating composition, the test plates were immersed in a chromic acid post-coating liquid (0.1% by weight of "DEOXYLYTE 40" of NIPPON PAINT) at normal temperature for 30 seconds, and then washed with water and dried. The same paints used in EXAMPLES 1-3 were applied to the sets of COMPARATIVE EXAMPLES 1-5 under the same conditions as in EXAMPLES 1-3, and the same tests were conducted. The results are summarized in Table 2.

As apparent from photographs 1 through 8, in COMPARATIVE EXAMPLES 1, 3 and 5, leaf-like crystalline, but good, even coatings are formed that exhibit poor adhesion to the cationic electrodeposited paint film, poor salt-water spray resistance, and poor point rust resistance. In COMPARATIVE EXAMPLES 2 and 4, blue iron phosphate coats are formed that have poor salt-water spray resistance and point rust resistance. In contrast, the coatings produced in EXAMPLES 1 through 3 of the invention have a plate-like crystal structure and are excellently even and dense, thus giving satisfactory adhesion to the cationic electrodeposited paint film, satisfactory salt-water spraying resistance, and satisfactory point rust resistance.

TABLE 2

| | Weight g/m$^2$ | Crystal Photo.# | Appearance | Salt-water Spraying (mm) | Adhesion (/100) | Point Rust (mm) |
|---|---|---|---|---|---|---|
| EXAMPLE 1 | 1.37 | 1 | good even & dense coating | 1 | 100 | 0.92 |
| EXAMPLE 2 | 1.28 | 2 | good even & dense coating | 1 | 100 | 0.87 |
| EXAMPLE 3 | 1.45 | 3 | good even & | 1 | 100 | 0.98 |

TABLE 2-continued

| | Weight g/m² | Crystal Photo.# | Appearance | Salt-water Spraying (mm) | Adhesion (/100) | Point Rust (mm) |
|---|---|---|---|---|---|---|
| COM. EX. 1 | 1.96 | 4 | dense coating good even & dense coating | 2.5 | 15 | 2.04 |
| COM. EX. 2 | 0.87 | 5 | poor blue & uneven coating | 3.5 | 100 | 5.13 |
| COM. Ex. 3 | 1.56 | 6 | good even & dense coating | 2.0 | 21 | 1.94 |
| COM. EX. 4 | 0.97 | 7 | poor blue & uneven coating | 3.5 | 100 | 5.56 |
| COM. EX. 5 | 1.64 | 8 | good even & dense coating | 1.5 | 40 | 1.53 |

TABLE 3

| | Comp. Ex. 1 | Comp. Ex. 2 | Comp. Ex. 3 | Comp. Ex. 4 | Comp. Ex. 5 |
|---|---|---|---|---|---|
| Aqueous Coating Composition (g/l) | | | | | |
| Zn ion | 0.60 | 0.60 | 0.30 | 0.20 | 1.74 |
| $PO_4$ ion | 14.3 | 14.3 | 10.30 | 10.26 | 6.0 |
| $ClO_3$ ion | 1.0 | 6.0 | 0.16 | 2.35 | — |
| $NO_2$ ion | 0.08 | 0.06 | 0.1 | — | 0.1 |
| Cu ion | — | — | — | — | 0.03 |
| Cl ion | — | 1.5 | — | 1.21 | — |
| $SiF_6$ ion | — | — | — | — | 1.51 |
| Treating Conditions | | | | | |
| Total acidity | 15.7 | 15.7 | 11.2 | 11.1 | 10.0 |
| Free acidity | 0.6 | 0.6 | 0.3 | 0.3 | 0.6 |
| Toner value | 2.0 | 1.5 | 2.4 | — | 2.4 |
| Treat. temp. (°C.) | 50 | 50 | 60 | 57 | 70 |
| Treat. time (minutes) | 2 | 2 | 2 | 2 | 2 |
| Spray. pressure (kg/cm²) | 0.8 | 0.8 | 0.8 | 0.8 | 0.8 |

EXAMPLES 4 through 6

Three sets of test plates, each set comprising a mixture of test plates of commercially available cold rolled steel (70×150×0.8 mm), and test plates of the same size and material whose surfaces were buffed, were prepared in the same way as in EXAMPLE 1 by removing the grease, and then washing with city water. Each set was treated with a coating composition as defined in EXAMPLE 1 of Table 1, but the coating composition was applied to each set by the intermittent spray method as defined in Table 4.

Then, they were washed with city water and deionized water and dried. The coatings thus formed were examined for the amount of the coating, the crystal structure, and the appearance of the coating. To evaluate performance with paint films, the same paints as in EXAMPLE 1 were applied. The results are summarized in Table 5.

TABLE 4

| Procedure for Intermittent Spray Application of Coating Composition | | |
|---|---|---|
| EXAMPLE 4 | EXAMPLE 5 | EXAMPLE 6 |
| spraying (15 sec.), suspension (15 sec.) & spraying (105 sec.) | spraying (15 sec.), suspension (15 sec.), spraying (10 sec.), suspension (10 sec.) & spraying (65 sec.) | spraying (20 sec.), suspension (20 sec.) & spraying (100 sec.) |

EXAMPLE 7

The same combination of test plates as in EXAMPLE 4 was treated similarly, by grease removal, water washing, and then coating with the zinc phosphate coating composition defined in EXAMPLE 1 of Table 1 under the conditions of EXAMPLE 1 in Table 1. The results of the evaluation of the coatings thus obtained are summarized in Table 5.

As is apparent from Table 5 and photographs 9 through 16, continuous spraying as employed in EXAMPLE 7 formed coatings affected by surface conditions, whereas the intermittent spraying employed in EXAMPLES 4–6 formed coatings not affected by surface conditions and having a plate-like crystal structure. The coatings of EXAMPLES 4–6 exhibited satisfactory adhesion to paint film applied by cationic electrodeposition, satisfactory salt-water spraying resistance, and satisfactory point rust resistance.

TABLE 5

| | Weight (g/m²) Buffing | | Crystal Photo # Buffing | | Appearance Buffing | | Salt-water Spray (mm) Buffing | | Adhesion (/100) Buffing | | Point Rust (mm) Buffing | |
|---|---|---|---|---|---|---|---|---|---|---|---|---|
| | No | Yes | No | Yes | No | Yes | No | Yes | No | Yes | No | Yes |
| EXAMPLE 4 | 1.43 | 1.38 | 9 | 10 | good even & dense coat | good even & dense coating | 1 | 1 | 100 | 100 | 0.85 | 0.89 |
| EXAMPLE 5 | 1.52 | 1.51 | 11 | 12 | good even & dense coat | good even & dense coating | " | " | 100 | 100 | 0.83 | 0.85 |
| EXAMPLE 6 | 1.31 | 1.30 | 13 | 14 | good even & dense coat | good even & dense coating | " | " | 100 | 100 | 0.88 | 0.93 |
| EXAMPLE 7 | 1.32 | 1.01 | 15 | 16 | good even & dense coat | somewhat poor good even coating | " | 1.5 | 100 | 50 | 0.92 | 1.41 |

It is believed that in practice the composition of the present invention will be used most widely in applications where the article to be coated is subjected to a continuous spray or an intermittent spray of the composition. Coatings can be formed from the composition when it is applied by other means, for example, by flow coat techniques.

We claim:

1. An acidic aqueous coating solution for forming a zinc phosphate coating on a metal surface consisting essentially of about 0.4 to about 1 g/l of zinc, about 5 to about 40 g/l of phosphate, about 0.01 to about 0.2 g/l of nitrite and about 2 to about 5 g/l of chlorate.

2. The composition of claim 1 wherein the concentration of zinc is from about 0.5 to about 0.9 g/l, the concentration of phosphate is from about 10 to about 20 g/l, the concentration of nitrite is from about 0.04 to about 0.15 g/l, and the concentration of chlorate is from about 2.5 to about 4 g/l.

3. The composition of claim 1 wherein the source of zinc is a compound selected from the group consisting of zinc oxide, zinc carbonate, and zinc nitrate.

4. The composition of claim 1 wherein the source of phosphate is a compound selected from the group consisting of phosphoric acid, alkali metal phosphate, zinc phosphate and nickel phosphate.

5. The composition of claim 1 wherein the source of nitrite is a compound selected from the group consisting of alkali metal nitrite and ammonium nitrite.

6. The composition of claim 1 wherein the source of chlorate is a compound selected from the group consisting of chloric acid, alkali metal chlorate, and ammonium chlorate.

7. The composition of claim 1 including at least about 0.2 g/l of one or more ions selected from the group consisting of nickel, cobalt, calcium, and manganese.

8. The composition of claim 7 wherein the concentration of said ion is from about 0.2 to about 2 g/l.

9. The composition of claim 7 wherein the source of nickel ion is a compound selected from the group consisting of nickel carbonate, nickel nitrate, nickel chloride, and nickel phosphate.

10. The composition of claim 7 wherein the source of cobalt ion is cobalt carbonate, cobalt nitrate, cobalt chloride, and cobalt phosphate.

11. The composition of claim 7 wherein the source of calcium ion is a compound selected from the group consisting of calcium carbonate, calcium nitrate, calcium chloride, and calcium phosphate.

12. The composition of claim 7 wherein the source of manganese ion is a compound selected from the group consisting of manganese carbonate, manganese nitrate, manganese chloride and manganese phosphate.

13. The composition of claim 1 or 7 including about 0 to about 4 g/l of a complex fluoride ion.

14. The composition of claim 1 or 7 including about 0 to about 5 g/l of chloride ion.

15. The composition of claim 1 or 7 including about 0 to about 15 g/l of nitrate ion.

16. An acidic aqueous composition for forming a zinc phosphate coating on a metal surface consisting essentially of about 0.5 to about 0.9 g/l of zinc ion, about 10 to about 20 g/l of phosphate ion, about 0.04 to about 0.15 g/l of nitrite ion, about 2.5 to about 4 g/l of chlorate ion, and about 0.2 to about 2 g/l of one or more ions selected from the group consisting of nickel, cobalt, calcium and manganese.

17. A process for forming a zinc phosphate coating on a metal surface comprising contacting the metal surface with an acidic aqueous coating composition comprising about 0.4 to about 1 g/l of zinc ion, about 5 to about 40 g/l of phosphate ion, about 0.01 to about 0.2 g/l of nitrite ion, and about 2 to about 5 g/l of chlorate ion.

18. A process according to claim 17 wherein said composition is sprayed on said surface.

19. The process of claim 18 wherein the metal surface is sprayed for longer than about 40 seconds.

20. The process of claim 19 wherein the metal surface is sprayed with the coating composition for about 1 to about 3 minutes.

21. The process of claim 20 wherein the metal surface is sprayed with the coating composition for about 1.5 to about 2.5 minutes.

22. The process of claim 18 wherein the temperature of the coating composition is about 40° to about 70° C.

23. The process of claim 22 wherein the temperature of the coating composition is about 50° to about 60° C.

24. The process of claim 18 wherein the pressure of spraying is about 0.5 to about 2 kg/cm$^2$.

25. A process for forming a zinc phosphate coating on a metal surface comprising subjecting the surface to at least one cycle of the following sequential steps:

(A) spraying the metal surface for about 10 to about 30 seconds with an acidic aqueous coating composition comprising about 0.4 to about 1 g/l of zinc ion, about 5 to about 40 g/l of phosphate ion, about 0.01 to about 0.2 g/l of nitrite ion, and about 2 to about 5 g/l of chlorate ion;

(B) suspending the spraying for about 5 to about 30 seconds; and then (C) spraying the metal surface with the coating composition so that the total time of spraying is longer than about 40 seconds.

26. The process of claim 25 wherein the first spraying is about 15 to about 25 seconds.

27. The process of claim 25 wherein the spraying is suspended for about 10 to about 20 seconds.

28. The process of claim 25 wherein the total time of spraying is about 1 minute to about 3 minutes.

29. The process of claim 25 wherein the temperature of the coating composition is about 40° to about 70° C.

30. The process of claim 29 wherein the temperature of the coating composition is about 50° to about 60° C.

31. The process of claim 25 wherein the pressure of spraying is about 0.5 to about 2 kg/cm$^2$.

32. The process according to claim 17 or 25 including applying to said zinc phosphate coating a paint film by cationic electrodeposition.

33. The process according to claim 17 or 25 including applying to said zinc phosphate coating a paint film by cationic electrodeposition, wherein said zinc phosphate coating is not treated with chromium prior to applying thereto said paint film.

34. A metal surface having thereon a zinc phosphate coating formed by the process of claim 17 or 25.

35. In a process wherein a zinc phosphate coating is formed on a metal surface by spraying the metal surface with an aqueous coating solution capable of forming thereon a zinc phosphate coating, wherein the coating solution tends to unduly etch the metal surface and/or form coatings characterized by imperfections such as being non-uniform, rusty or a blue-iron phosphate coating, the improvement comprising subjecting the metal surface to at least one cycle of the sequential steps which include spraying the metal surface with the coating solution and thereafter suspending the spraying of the solution for time periods sufficient to form crystalline nuclei which function as sites for the subsequent formation of plate-like crystal structures, and thereafter spraying the metal surface with the composition for a period of time sufficient to form said plate-like crystals, wherein the coating solution which is intermittently sprayed on the metal surface as aforesaid consists essentially of the coating solution defined in claim 1, 2, 3, 4, 5, 6, 7, 8, 9, 10, 11, 12 or 16, and including applying to the zinc phosphate coating a paint film by cationic electrodeposition.

36. The process according to claim 35 wherein the metal surface is initially sprayed for about 10 to about 30 seconds, then spraying is suspended for about 5 to about 30 seconds, and thereafter the metal surface is sprayed so the total time of spraying is longer than about 40 seconds.

37. The process according to claim 35 wherein the metal surface is iron or zinc.

* * * * *